United States Patent [19]

Boggs

[11] 4,089,089

[45] May 16, 1978

[54] METHOD OF UNWINDING

[75] Inventor: Beryl Aaron Boggs, Chester, Va.

[73] Assignee: Allied Chemical Corporation, Morris Township, N.J.

[21] Appl. No.: 716,624

[22] Filed: Aug. 23, 1976

Related U.S. Application Data

[62] Division of Ser. No. 360,237, May 14, 1973, Pat. No. 3,980,176, which is a division of Ser. No. 107,386, Jan. 18, 1971, Pat. No. 3,757,010.

[51] Int. Cl.[2] ..... B65H 54/76; B65H 67/00

[52] U.S. Cl. ..... 28/299

[58] Field of Search ..... 28/1 CS, 1.3, 19, 72 SP, 28/72 CS; 206/83.5, 392, 410, 497; 53/24, 177; 141/12, 67; 83/4; 242/128

[56] References Cited

U.S. PATENT DOCUMENTS

| | | | |
|---|---|---|---|
| 1,937,468 | 11/1933 | Talbot | 206/497 |
| 2,879,581 | 3/1959 | Evans et al. | 28/1 CS |
| 3,313,323 | 4/1967 | Calemard | 28/1 CS |
| 3,389,445 | 6/1968 | Schreffler | 28/1.3 |
| 3,619,875 | 11/1971 | Gates | 28/72 SP |

FOREIGN PATENT DOCUMENTS

| | | | |
|---|---|---|---|
| 2,088,655 | 7/1972 | France | 53/30 S |

*Primary Examiner*—Louis K. Rimrodt
*Attorney, Agent, or Firm*—Richard A. Anderson

[57] ABSTRACT

This high speed yarn take-up system consists of a pneumatic injector nozzle rotatably mounted off-center of a single flighted rotating screw. Yarn is injected into the area exposed at the trailing edge of the screw and compressed and moved forward in a compression chamber by the feeding of the screw. A plastic tube is continuously formed around the compression chamber to receive the yarn mass as it discharges, thus forming a tube of indefinite unlimited length and from ¼ to 4 inches or larger in diameter. The tube may contain a single end or multiple ends of yarn. The yarn can be removed from the tube at high speeds by simply slitting the plastic as the yarn is pulled from the package.

5 Claims, 5 Drawing Figures

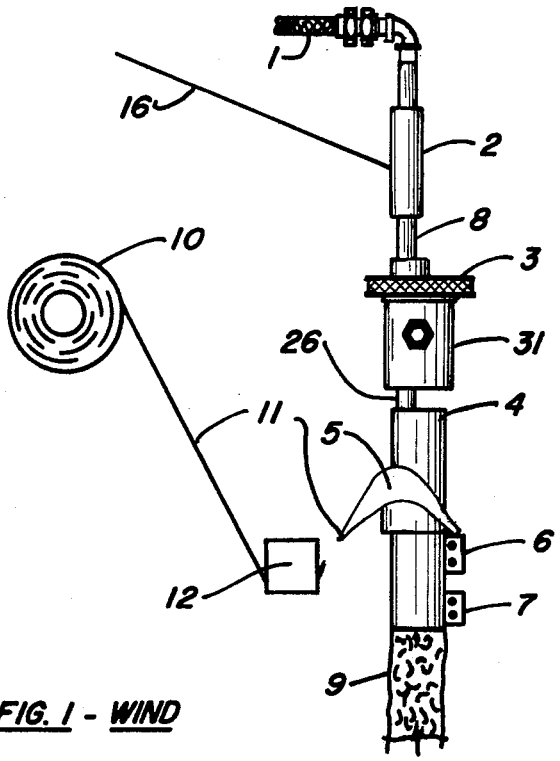
FIG. 1 - WIND
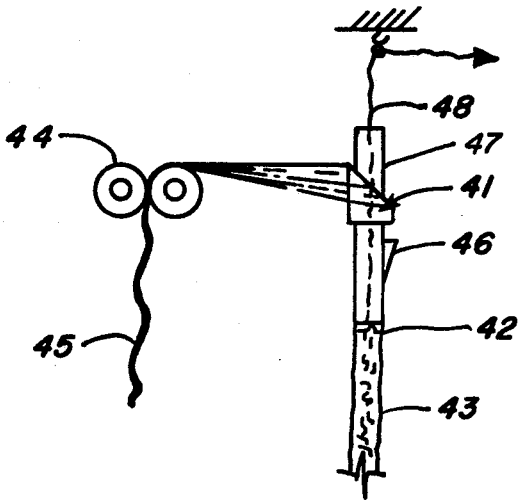
FIG. 2 - UNWIND

METHOD OF UNWINDING

This is a division of application Ser. No. 360,237, filed May 14, 1973, now U.S. Pat. No. 3,980,176, which was, in turn, a division of application Ser. No. 107,386, filed Jan. 18, 1971, now U.S. Pat. No. 3,757,010.

BACKGROUND OF THE INVENTION

This invention relates to a take-up method, apparatus and package for continuous textile fibers.

At present all commercial packaging of yarn is done by rotating a tube, cone, or bobbin and winding yarn on it as the yarn is traversed back and forth from one end of the package to the other. In the U.S. patent literature, four patents to Russo et al. U.S. Pat. Nos. 2,960,729, 3,000,059, 3,027,108, and 3,058,690, disclose apparatus, method and package using a stuffer crimper to lay crimped fiber into a tube of plastic film. These four patents are distinguished from applicant's invention in that the Russo patents disclose that a stuffer crimper must be used prior to packaging the yarn, the yarn is heat set in the package, and the yarn is allowed to lay in an open gap between the stuffer box and the film tube before the package is made. Thus, these prior art Russo patents show no way to compress or pack the yarn into the package. The yarn compressed as in applicant's invention would pop out of the gap between the stuffer box and the film tube package in the prior art method, Also, in order to use the Russo et al. invention, the yarn must be crimped. Applicant does not crimp the material being packaged.

SUMMARY OF THE INVENTION

This invention is a textile yarn, or other material that can be conveyed with fluid thorough a conduit, packaging system capable of high speeds and large package size utilizing an integral jet and screw compressor feeding yarn to a compression tube and a formed film tube enclosure. The textile yarn take-up and packaging apparatus comprises the combination of a pressurized fluid supply means connected to a fluid jet assembly which receives air from the fluid supply means and receives yarn from the yarn supply means. The fluid jet assembly is constructed to move the yarn along with the fluid from the fluit jet through a conduit to a nozzle having an outlet set eccentrically in the first flight of a screw having at least one flight. The screw is rotatably mounted in a compression tube which receives yarn from the nozzle and discharges a continuous wad of compressed yarn into the package. As the screw is rotated in the compression tube, and yarn is fed into it, film is supplied to a tube former mounted around the compression tube so that a tube of the film forms around the compression tube to form a long tube of film containing the yarn. The yarn is continuously compressed into the tube of film from the compression tube as a continuous compressed wad. The continuous wad is formed by a continuous strand or strands of the yarn or staple or other fluid conveyable material being blown into the comression tube from the nozzle. The first flight of the rotating screw pushes the continuous yarn wad from the compression tube into the long tube of film. The screw can rotate at any operable speed, but from 20 to 2,000 rpm is preferred, and 500 to 1,000 rpm is particularly preferred. Alternatively, the screw could be stationary while the compression tube is rotated, when mounted coaxially. The pressurized fluid may be air at 20 to

150 psi. The pressurized fluid can also be heated, such as steam or heated air. The fluid jet assembly may have a Venturi opening to blow yarn which enters below the Venturi outlet so that the yarn and the air blow through a conduit to the nozzle. The screw and screw assembly are preferably mounted coaxially in the compression tube so that the continuous wad of yarn is urged into the tube of film without any angle, however, it could be mounted at a right angle or any other angle in the stuffer tube. Preferably the compression tube is cylindrically shaped; however, it is possible to have square or other geometric shapes so long as the screw will urge the wad through the compression tube. The film which is formed into a tubular package can be any type of film, but is preferably a sealable film, and even more particularly preferable heat sealable film, such as nylon, mylar, or polyethylene. Polyethylene is particularly attractive because of low cost.

By sealable is meant film which may be glued, pasted, taped, heat-sealed, or sealed by any means to close edges of the film into tube, such as jointly crimping overlapping edges.

Preferably, there should be clearance between the screw and the compression tube in order for the fluid, such as air, to escape as it discharges from the nozzle outlet. The preferable screw clearance depends on the denier per filament of yarn being processed. The clearance should be greater than the thickness of the individual filaments so that the filaments are not wedged into the clearance between screw and compression tube, i.e., the filaments blown into the clearance have enough "room" to come back out. For 1125 denier, 70 filament yarn, this screw clearance is preferably from about 0.002 to about 0.003 inch radially. Also, holes may be drilled or slots made in the screw flight to permit air to escape after discharge. With these orifices in the screw, the clearance could be zero, with special sealing means at the bearing surface.

The screw pitch can be any pitch which will move the wad of yarn as it is laid down by the nozzle. Preferably screw pitch is determined by tube diameter to provide optimum lead angle (angle of incline) on the screw flight. For purposes of this discussion, lead angle is determined along the outside diameter of the screw. Optimum lead angle is from about ½° to about 10°. Successful runs were completed using a 1¼ inch compression tube with screw having 174 inch pitch, lead angle 3°50'; ⅜ inch pitch, 5°45' lead angle; and ½ inch pitch, 7°40' lead angle. Also important to the effectiveness of moving the compressed wad of yarn is the surface finish or coating on the face of the screw flight and inner surface of the compression tube. Preferred surface characteristics can be determined for the type of yarn being processed, bulk density desired, size and pitch of screw and other factors. The bulk density is also controlled by the tension on the tube of film as it contacts the continuous compressed wad of yarn as the yarn wad exits the compression tube. Increased tension on the newly formed film tube compresses the yarn to increase bulk density. This tension can be controlled by a friction drag weight on the film roll, such as a weighted strap draped over the top of the roll or by causing drag on the film as it passes through guide rolls prior to forming the tube. Braking means on either the film roll axle or the guide rolls could be used. The braking means can also stop movement of the tube when the apparatus is shut off so that the compressed yarn does not urge the film downward to an unsealed portion at the bottom of the compression tube. The achievable range of bulk density varies with the type of yarn being processed. Heavy yarns such as glass or metal would necessarily have high bulk density, while the natural and synthetic polymers would vary according to their polymer density, denier, fiber characteristics such as crimp, twist, entanglement and other texture factors.

In addition to yarn or textile fibers, the apparatus, method and package of this invention can be used to take-up and package any material that can be conveyed by fluid through a conduit. For example, tape, fabric, ribbon, twine, rope, string, gauze, split film, fibers from split film and many other conveyable articles can be taken-up and packaged with this invention. Particularly interesting is packaging sterilized gauze into a sterile package of film by means of this invention. Whenever yarn or textile is described in this specification these other fluid conveyable materials are also applicable.

For this invention, the textile fibers processed and packaged are any of the known textile fibers. The fibers may be either natural, such as cotton and wool, synthetic polymers such as polyamide, polyester, acrylic, modified acrylic or inorganic such as glass and metal fibers. Any fiber that can be moved with pressurized fluid can be used, whether continuous filament, spun yarn, or even staple.

The package of this invention is a package of unlimited length of textile fibers or other fluid conveyable material comprising a continuous core of yarn compactly folded within each convolution of a substantially uniform helically, compactly wound convoluted mass of yarn. This yarn is compressed within a long tube of flexible impervious material. The compacted, folded and helically wound mass of yarn is compressed in the tube so that the mass of the yarn expands after removal of the tube film from about the mass. The length of the package is unlimited. Practically, the length is limited only by feasibility of means to handle the packages. Preferably, the diameter of the package corresponds to the compression tube diameter, about ¼ inch to 4 inches or larger. Preferably the bulk density of this mass of yarn varies between 0.001 pound per cubic inch to 0.04 pound per cubic inch, for yarns of synthetic or natural fiber and up to 0.05 for other yarn. Another advantage of this invention is that the package can be unwound from either end, that is, yarn first put into the package can be first taken off. In the present commercial yarn packages the first-wound yarn must be the last yarn unwound. Thus, the package of this invention permits processing yarn, i.e., drawing, texturizing, twisting, etc., in the same order as it was spun, permitting improved mergability.

The method of this invention is taking up and packaging textile yarn by moving the yarn with a moving fluid through a conduit to a nozzle having an outlet set eccentrically in the first flight of a screw having at least one flight, then discharging the yarn and fluid in a compression tube so that the yarn is folded and compacted, while rotating the screw so that the folded compacted yarn is laid down in a helically wound convolution within the compression tube. The convolutions of folded yarn form a compact mass of yarn. The screw moves the compact mass of yarn through the compression tube as the first flight of the screw rotates. Alternatively,, the compression tube could rotate as the screw remains stationary. The compact mass of yarn is discharged from the compression tube into a confining tube of film material so that a long tube of the flexible material containing the compact, compressed and folded within each convolution of helically wound yarn results. Preferably, the yarn is moved with a fluid which is discharged from a jet. Fluid is preferably air at a preferably pressure of 10 to 150 psi.

The apparatus, method and package of this invention can be used on single ends of yarn or multiple ends of yarn. The diameter of the tubing and compression tube can be from as small as ¼ inch or smaller and as large as practically feasible, but preferably about 4 inches. Doffing of the package is performed without interrrupting the packaging process by simply cutting off a piece of the package. Yarn can be packaged with this method at spinning take-up, drawing take-up, texturizing take-up, coupled spin-draw, spin-draw texturize, or draw-texturize take-up, or finally yarn packaging for shipment.

The resulting package of this invention can be used as a sales package for tufting or other applications or for an in-plane package for conveying the doffed packages between processing positions. This invention can be used for multiple end take-up with or without provision for separating ends. The film of this package protects the yarn during lag time from atmospheric effects on yarn properties. Thus, humidity control can be achieved without air-conditioning operating areas. Yarn is also protected from dirt and other environmental hazards. The package of this invention can also be used as a Nystock container for shipment to the customer, thus improving Nystock packaging from a bail to a package. The new package of this invention can also be used as a yarn scrap container for depolymerization processing.

The yarn fed to the take-up and packaging system of this invention can be texturized, entangled or flat. Yarn characteristics are substantially unchanged by this invention, i.e., no crimp or other texture is imparted by the take-up or package, so that flat yarn remains untextured and textured yarn receives no further discernable texture.

The resulting package of this invention has a hollow continuous core when continuous filament yarn is taken-up. This hollow continuous core is formed as the yarn is continuously compactly folded when it exits the nozzle in the screw, then the compactly folded yarn is urged into a helical winding or convolution by the action of the screw rotating, leaving the internal portion of continuous core hollow and urging the previously formed helix of compactly folded yarn forward in the stuffer tube. A unique feature of this package is that the compressive force is entirely longitudinal, i.e., along the axis or long direction of the package. There is no sidewise, lateral or radial compressive force. In fact, the typical package has some slack film around the circumference. The continuous wad of helically wound compressed yarn is radially self-supporting much like a coiled helical spring.

The package of this invention resembles a continuous sausage in that yarn is packed into a long tube of flexible film. This "sausage" of compacted yarn can be received in any convenient method as it is formed. Since the yarn is protected in the package, it could just be left to randomly pile up wherever it falls, but preferably the continuous "sausage" would randomly pile or piddle into a container for easy transportion to subsequent processing areas, storage or sale.

BRIEF DESCRIPTION OF DRAWINGS

FIG. 1 is a partially schematic elevation view showing the apparatus of this invention.

FIG. 2 is an elevation view, partially schematic, showing an apparatus to unwind the package of this invention.

DESCRIPTION OF THE PREFERRED EMBODIMENTS

Figures 3, 3A:
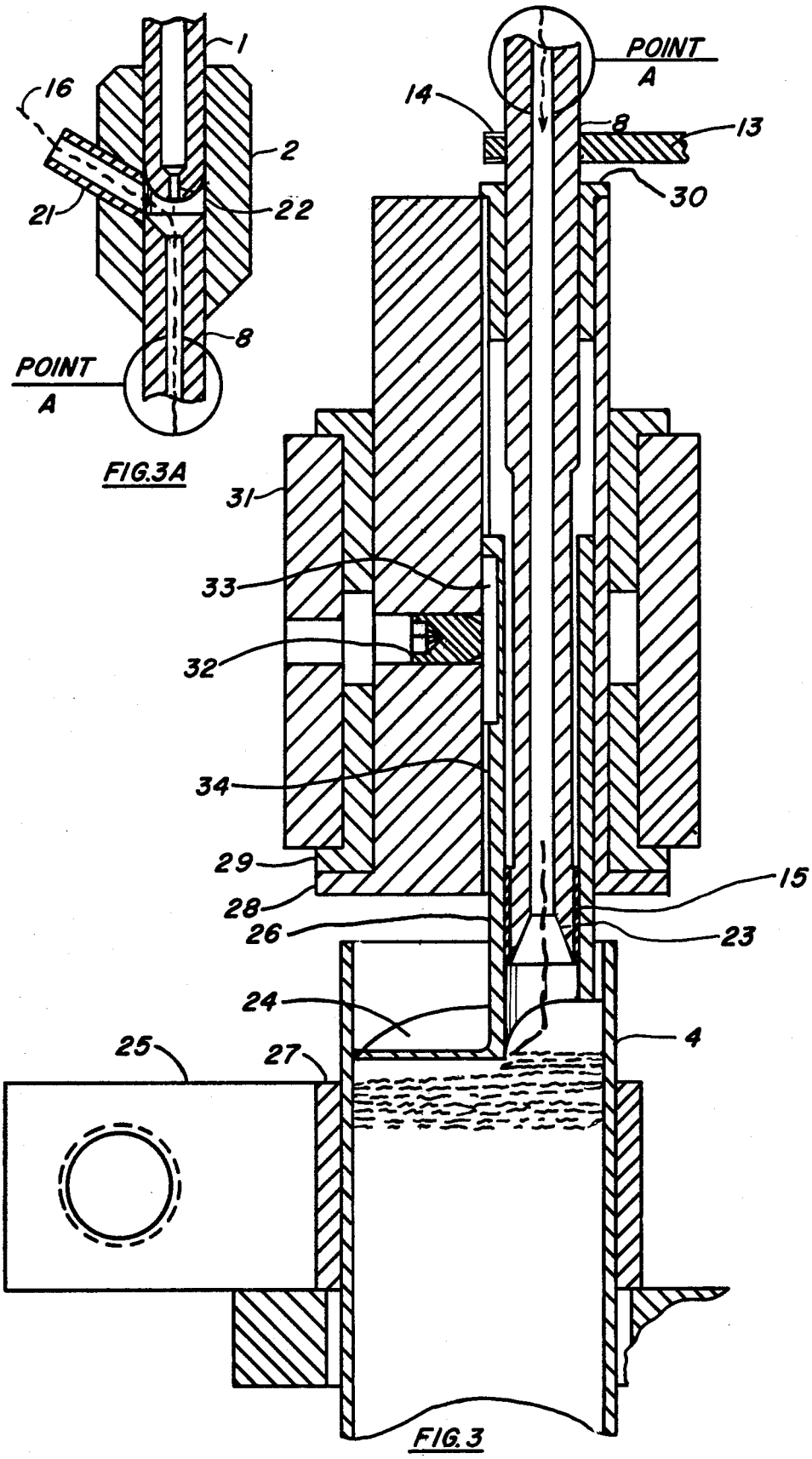
FIG. 3 is a cross-setion of the lower portion of the yarn conduit and nozzle, screw and compression tube, showing the relationship of these three elements.
FIG. 3*a* is a cross-section view of the air jet assembly.

FIG. 1 shows the elevation view of a preferred embodiment of this invention. Air enters from air supply 1 connected to air jet assembly 2 where yarn 16 is fed at an angle as shown. Alternatively, the entry of air and yarn could be from the same tube or from reversed positions of air entrance at the side, yarn from the top. Air and yarn travel through yarn conduit 8 to compression tube 4 while film 11 from film roll 10 travels through guide rolls 12 to film former 5 where it is formed into a tube around the outside portion of compression tube 4 and sealed by heat sealer 6 and subsequently cooled by seal cooler 7. Yarn package 9 forms below compression tube 4 as shown. Screw drive pully 3 rotates pivot shaft 28 shown in FIG. 3. Screw drive pulley 3 is moved by means not shown.

FIG. 2 shows how a package formed as in FIG. 1 can be unwound. The tube stripper consists of knife edge 46 which slits plastic film package 43 as stripping rolls 44 pull the plastic film over tube 47, and out of former 41. Knife edge 46 can be replaced by a heated wire when the film is thermoplastic. Simultaneously yarn 48 is pulled away by means not shown at a constant rate. A yarn level 42 is maintained upstream of slitting by regulating the rate at which the film is removed by rolls 44. By moving rolls 44 closer to tube 47, former 41 can be eliminated. Slit film 45 can be accumulated as waste.

In FIG. 3 yarn and air travel through conduit 8 to exit at yarn nozzle outlet 23 into compression tube 4. Yarn is laid down in folds at a high rate of speed on top of the continuous wad of yarn in compression tube 4. This folded, convoluted yarn forms a helix as screw 24 turns, urging forward the wad of yarn in compression tube 4. Also, as screw 24 turns, yarn nozzle outlet 23 revolves within the circumference of compression tube 4 to form the helix of folded convolution yarn within compression tube 4. Thus, it can be seen that yarn is injected into the area exposed by the trailing edge of screw 24, then compressed and urged through the compression tube by the feeding of screw 24. Rotation of screw 24 and revolution of yarn conduit 8 is by means of screw drive pulley 3 shown in FIG. 1. Yarn conduit 8 is mounted within screw assembly 26 as shown. Compression tube 4 is mounted by means of adapter 27 in tube mount 25. Yarn conduit 8 is mounted in bearing 30 eccentrically in pivot shaft 28.

Conduit 8 is rigidly mounted in linking arm 13 by set screw 14. Linking arm 13 has a slot at the end not shown, so that arm 13 is mounted with the slot on a rigid pivot point not shown to allow arm 13 to reciprocate and rotate slightly as conduit 8 revolves along the circumference of compression tube 4. Conduit 8 is also mounted in bearing 15 so that screw assembly 26 can rotate about conduit 8. Note that conduit 8 should not rotate when yarn 16 is supplied at the side of jet assembly 2 for yarn 16 would undesirably be wound around jet assembly 2 unless conduit 8 is rotatably mounted in jet assembly 2. Pivot shaft 28 is in turn mounted in bearing 29 in housing 31. Screw assembly 26 is rigidly mounted in pivot shaft 28 with set screw 32, seated on key 33, in keyway 34. Pivot shaft 28 is rotated by pulleys shown in FIG. 1 by power means not shown. Thus, conduit 8 revolves but does not rotate in pivot shaft 28 and pivot shaft 28 rotates within housing 31 providing the rotation for the screw assembly 26.

FIG. 3*a* shows air jet assembly 2 which extends so that conduit 8 is an integral part as shown by identical points A in FIGS. 3 and 3*a*. Yarn 16 enters through yarn entry tube 21. Air enters through air supply line 1 and impinges on yarn 16 through air jet 22 thus urging yarn 16 through yarn conduit 8. It is the impetus of air through jet 22 which folds yarn 16 in convolutions as it exits from yarn nozzle outlet 23.

Figure 4:
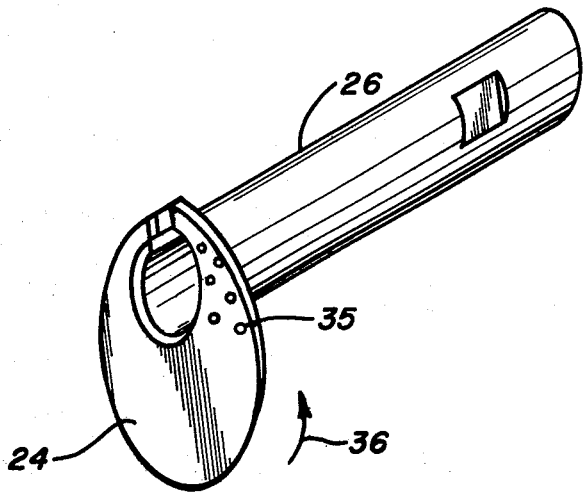
FIG. 4 is an isometric view of the screw assembly.

FIG. 4 shows screw assembly 26, with screw 24 having orifices 35 to permit escape of fluid as it exits from nozzle outlet 23, shown in FIG. 3. Arrow 36 shows direction of rotation of screw 24 when in use.

EXAMPLE

Using apparatus shown in FIGS. 1 and 3, yarn packages were formed as follows. Air pressure was kept between 55 and 70 pounds, preferably controlled at 60 psi. The screw jet revolved at 560 rpm. The screw pitch was ¼ inch, lead angle was 3°50′, and the tube diameter was 1¼ inches. The screw clearance was about 0.0025 inch. A series of holes were drilled in the first flight of the screw to allow passage of air after it exits from the yarn nozzle outlet. The following yarns were packaged in 1¼ inches continuous packages at the yarn speeds shown.

| | | | | | | |
|---|---|---|---|---|---|---|
| Yarn Denier | 1125 | 1125 | 2250 | 2250 | 3300 | 3375 |
| Yarn State | drawn-textured | drawn | drawn | drawn-textured | un-drawn | drawn-textured |
| Yarn speed, ft/min. | 2100 | 2100 | 1800 | 1800 | 1200 | 1200 |
| Number of ends | 1 | 1 | 2 | 2 | 1 | 3 |
| Number of Filaments per End | 70 | 70 | 70 | 70 | 210 | 70 |

Successful packages were produced of all the above yarns.

I claim:

1. A method of unwinding a package of textile fibers comprising a continuous core of yarn, said yarn being compactly folded within convolutions of a uniform helically, compactly wound mass of yarn, said yarn compressed within a long tube of flexible material, said folded and helically wound mass of said yarn being compressed in said tube so that said mass of said yarn expands after removal of said tube from around said mass comprising continuously (a) passing the tube of flexible material over a (b) rigid tube having rigidly mounted thereon slitting means, and (c) slitting said tube, while (d) withdrawing the compacted yarn.

2. The method of claim 1 wherein said slitting means is a knife.

3. The method of claim 1 wherein said slitting means is a heated wire.

4. The method of claim 1 wheren said yarn is withdrawn through said rigid tube at a constant rate and the rate of flexible film removal is controlled to maintain a level of compacted yarn in said tube of flexible material upstream of said slitting.

5. A method of unwinding a package of fluid conveyable material comprising a continuous core of said fluid conveyable material compactly folded within convolutions of a uniform, helically compactly wound mass, said conveyable material compressed within a long tube of flexible material, said folded and helically wound mass of said conveyable material being compressed in said tubes so that said mass of said conveyable material expands after removal of said tube from around said mass comprising continuously passing the tube of flexible material over a rigid tube having rigidly mounted thereon slitting means and slitting said tube, while withdrawing the compacted fluid conveyable material.

* * * * *